United States Patent [19]

Lopez

[11] Patent Number: 4,998,411

[45] Date of Patent: Mar. 12, 1991

[54] EXTERNAL COMBUSTION ENGINE WITH IMPROVED PISTON AND CRANKSHAFT LINKAGE

[76] Inventor: Frank Lopez, 302 Sierra Woods Dr., Sierra Madre, Calif. 91024

[21] Appl. No.: 458,609

[22] Filed: Dec. 29, 1989

[51] Int. Cl.[5] ..... F02G 1/053

[52] U.S. Cl. ..... 60/517; 74/49; 74/55; 74/837

[58] Field of Search ..... 60/517, 524, 525, 526; 74/45, 49, 55, 828, 837

[56] References Cited

U.S. PATENT DOCUMENTS 4,444,011 4/1984 Kolin ..... 60/517

4,532,819 8/1985 Ross ..... 74/45 X

*Primary Examiner*—Allen M. Ostrager

*Attorney, Agent, or Firm*—Christie, Parker & Hale

[57] ABSTRACT

An external heat engine has a piston mounted for movement between a first upper position and a second, lower position, a heater for heating a working gas to forcibly move the piston from the upper position to the lower position (power stroke), a crankshaft rotatable about a main axis, the piston and crankshaft being linked so that movement of the piston from the upper position to the lower position during the power stroke is transformed into rotational movement of the crankshaft during a first portion of one rotation of the crankshaft about the main axis. The piston moves from the lower position to the upper position during a second portion of one rotation of the crankshaft (compression stroke). The piston and crankshaft are linked by a disk, a piston rod connected to the piston and a connecting ring for rotatably supporting the disk. The disk is rotatable about its central moveable axis, and is connected to the crankshaft at a point offset from the disk's axis, for rotation about the disk's axis in response to rotation of the crankshaft about its main axis, the axis of the disk being disposed so that when the piston is in the upper position, the axis of the disk is substantially aligned with the main axis of the crankshaft during a third portion of one rotation of the crankshaft about the main axis. With this structure, the piston is maintained in the upper position for substantially 180° of rotation of the crankshaft.

18 Claims, 13 Drawing Sheets

285°

EXTERNAL COMBUSTION ENGINE WITH IMPROVED PISTON AND CRANKSHAFT LINKAGE

FIELD OF THE INVENTION

The present invention relates to an external combustion piston-type engine, and more particularly, to a piston and its linkage with a crankshaft in an external combustion engine.

BACKGROUND OF THE INVENTION

In general, in an external combustion engine, such as disclosed in U.S. Pat. No. 4,077,221 (to Maeda), combustion takes place outside of a gas expansion chamber. A working gas is heated by the combustion, and enters the expansion chamber where the gas expands due to the heat and pushes a piston downward to deliver a power stroke. Through a linkage between the piston and crankshaft, the power stroke causes the crankshaft to rotate. After the power stroke, the piston moves upward and the gas is pushed out of the expansion chamber through an exhaust. In a closed cycle process, the exhausted gas is cooled and recirculated for use in the compression chamber, and later is reheated and re-enters the expansion chamber. In an open cycle, the gas is simply exhausted.

To make such an engine as efficient as possible, it is necessary to transform as much of the combustion energy as possible into heat energy of the gas. The longer the piston remains in the up position, the longer heat transfer between the combustion chamber and the gas can occur. It is thus desirable to create an external combustion piston-type engine in which the piston remains in the up position for a substantial portion of each cycle. It is also desirable to have the piston in the up position for a substantial amount of the cycle so that combustion can take place more thoroughly and therefore burn the fuel more efficiently.

SUMMARY OF THE INVENTION

In accordance with the invention, there is provided an improved linkage between a piston and a crankshaft of an external combustion piston-type engine, having a power stroke and a compression stroke cycle. The linkage is such that during the time between completion of the compression stroke and the beginning of the power stroke, the piston is maintained in its upper position for substantially 180° of the rotation of the crankshaft.

In one embodiment of the invention, the piston is connected to the crankshaft via a connecting rod. The connecting rod comprises a ring having a central bore. A disk is disposed in the bore so as to be rotatable with respect to the ring. The disk has a hole therethrough offset from its central axis.

The crankshaft has a central shaft and a radially extending crank arm. A crank pin is fixially attached to the crank arm so that as the central shaft rotates, the crank pin rotates orbitally about the axis of the crankshaft. The crank pin extends through the hole or aperture in the disk and rotatably engages the disk, i.e. the disk is rotatable relative to the crank pin.

Rotation of the crank pin about the crankshaft results in upward and downward movement of the piston. In the cycle, the piston moves upwardly into its upward position as the crank pin rotates from a position directly below the crankshaft, i.e. the 0° position, to a position wherein the crank pin is at the same elevation as the crankshaft, i.e. the 90° position. At this point, the disk and the crankshaft are coaxial. The piston remains in its up position as the crank pin rotates one-half turn to about its 270° position, movement of the crank pin being accommodated by clockwise rotation of the disk relative to the ring.

As the crank pin rotates downwardly past its 270° position, it carries the disk, connecting rod and piston downwardly. As this occurs, the disk rotates relative to the crank pin in a counterclockwise position. When the crank pin reaches its 0° position directly below the connecting rod, the disk, connecting rod and piston are at their lowest point. As the crank pin continues to rotate past the 0° position, the disk, connecting rod and piston begin to move upwardly, repeating the cycle.

In a further embodiment of the invention, the connecting ring is integrally attached to a pivot arm to provide greater stability of the motion of the piston, piston rod and connecting ring.

BRIEF DESCRIPTION OF THE DRAWINGS

The above and further features and advantages of the invention will become more evident upon a reading of the detailed description set forth below in conjunction with the drawings, in which.

DETAILED DESCRIPTION

The invention provides an improved linkage between a piston and a crankshaft of an external combustion piston-type engine.

Figure 1:
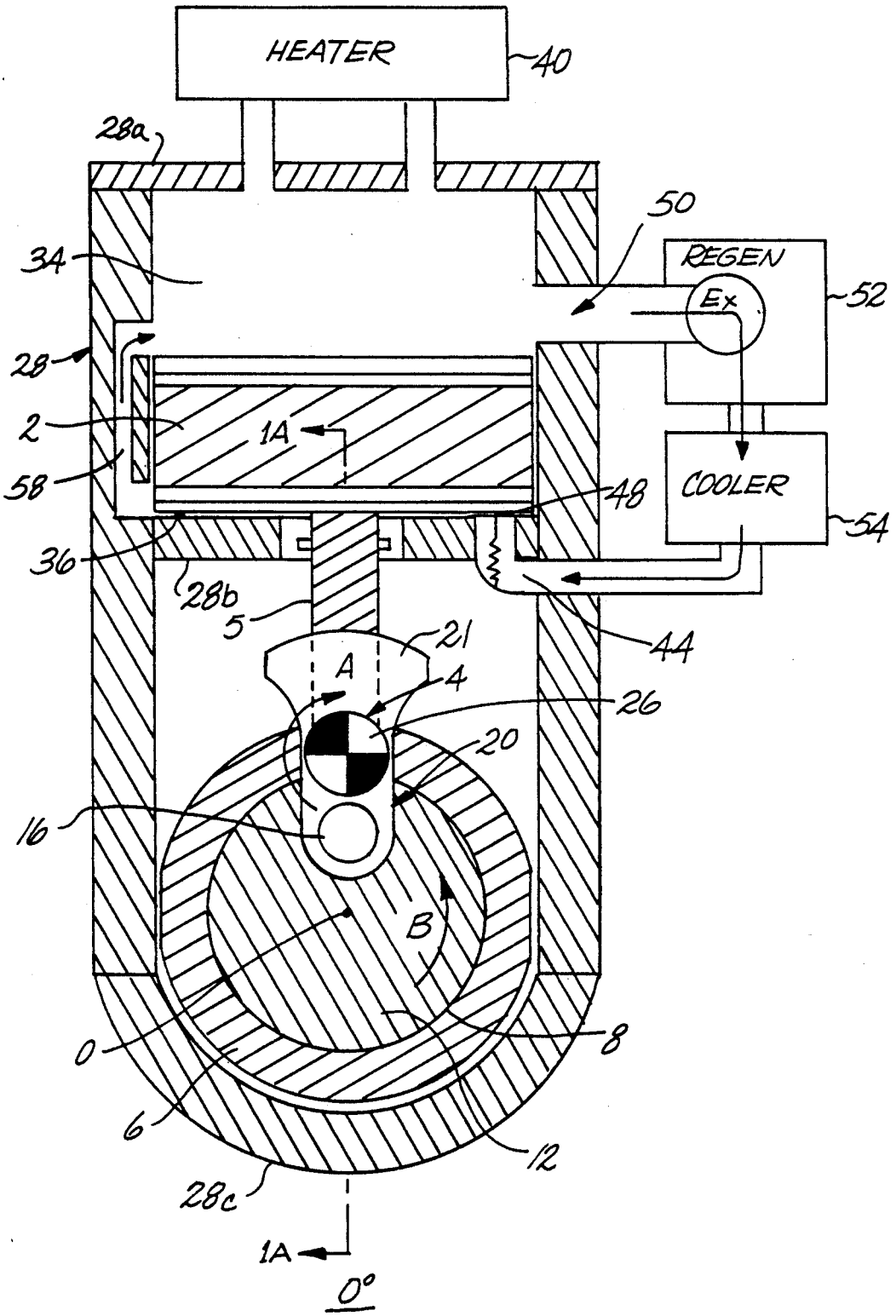
FIG. 1 is a cross-sectional view of a closed cycle-type external combustion piston-type engine, with the piston at the bottom of its stroke and with the crankshaft at zero degrees of rotation.
Figure 1A:
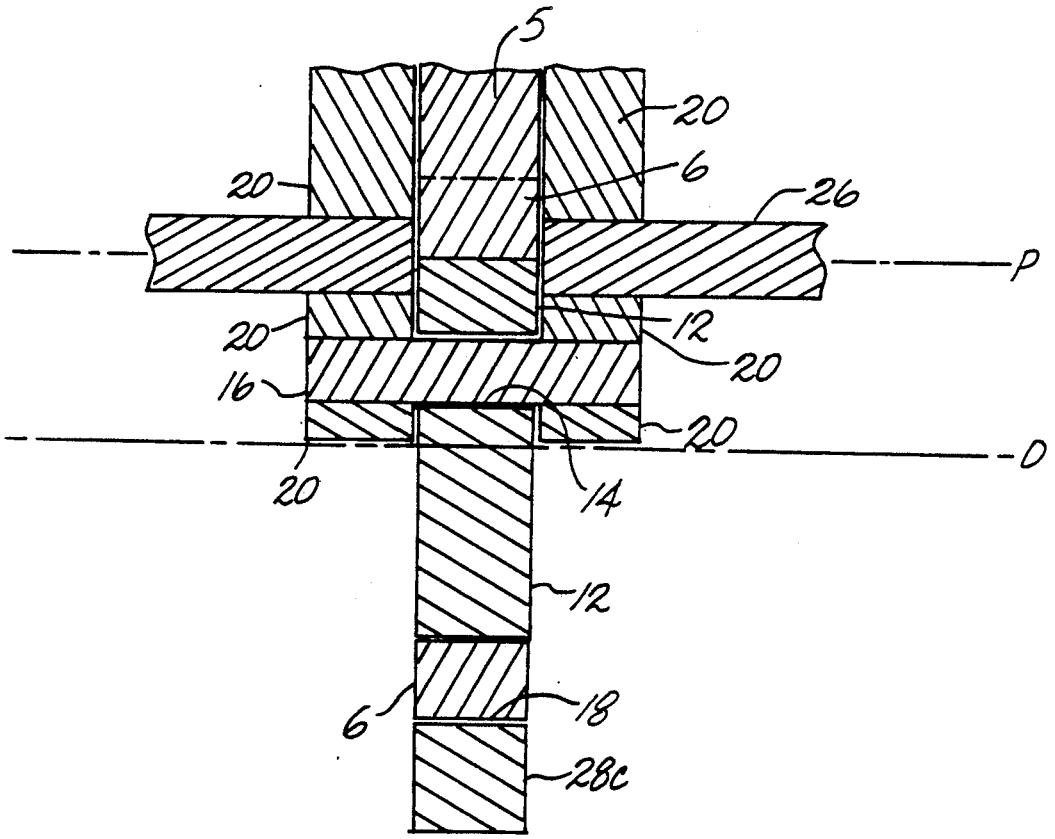
FIG. 1A is a cross-sectional view, taken along line 1A—1A of FIG. 1, of the crankshaft, and the elements linking the piston with the crankshaft.

FIG. 1 shows a cross-sectional view of an external combustion engine, including a piston 2 and its linkage to a crankshaft 4, and FIG. 1A is a cross-sectional view, taken along line 1A—1A of FIG. 1, of details of the linkage between piston 2 and crankshaft 4. The piston 2 has a connecting rod 5 attached to its bottom end. Connecting rod 5 comprises a connecting ring 6, which has a cylindrical bore 8. The bore 8 has a disk 12 rotatably disposed (about axis 0) therein. The disk 12 has a hole 14 offset from its axis.

As shown in FIGS. 1 and 1A, crankshaft 4 comprises a segmented central shaft 26. Mounted on shaft 26 are radially extending crank arms 20. A crank pin 16 is mounted on the crank arm, the axis of the crank pin 16 being generally parallel with the axis of the shaft 26. Rotation of the shaft 26 results in orbital rotation of the crank pin 16 about the shaft 26. Crank arm 20 comprises a counterweight 21 extending from the shaft 26 in a direction opposite the crank pin 16. As shown in FIG. 1A, the crank pin extends through the hole 14 in the disk 12 so that the disk 12 is afforded rotatable movement relative to the crank pin.

In FIG. 1, the piston is at the beginning of a cycle. The piston 2 is at its lowest position. Crank pin 16 is also at its lowest position. The position of the crankshaft, at which pin 16 is at its lowest position and the piston is at its lowest position, will be referred to as 0° (about axis P) for a reference.

Piston 2 is moveable between an expansion chamber 34 and a compression chamber 36. Expansion chamber 34 is largest when piston 2 is at its lowest position, and the compression chamber is thus smallest in this position. When piston 2 is at its highest or top position, expansion chamber 34 is smallest and compression chamber 36 is largest. Piston 2 thus forms a moveable border between chambers 34, 36. The piston 2, connecting rod 5 and disk 12 are mounted in a suitable housing 28, which has a top 28*a* and a shelf 28*b* which define the upper border of expansion chamber 34 and lower border of compression chamber 36, respectively. The engine has a heater 40 disposed at top 28*a* for heating the working gas. At the 0° position of the crankshaft, the compression stroke of piston 2 is about to begin. At this point, cool working gas from compression chamber 36, which has previously entered through a port 44, has finished entering into expansion chamber 34. As crankshaft 4 rotates clockwise in FIG. 1, compression begins. Piston 2 moves upwardly due to an upward force on connecting ring 6 transmitted from crank pin 16 of crankshaft 4 to disk 12. Arrow A shows the direction of rotation of pin 16, and arrow B shows the counterclockwise rotation of disk 12 in response to rotation of pin 16.

Figure 2:
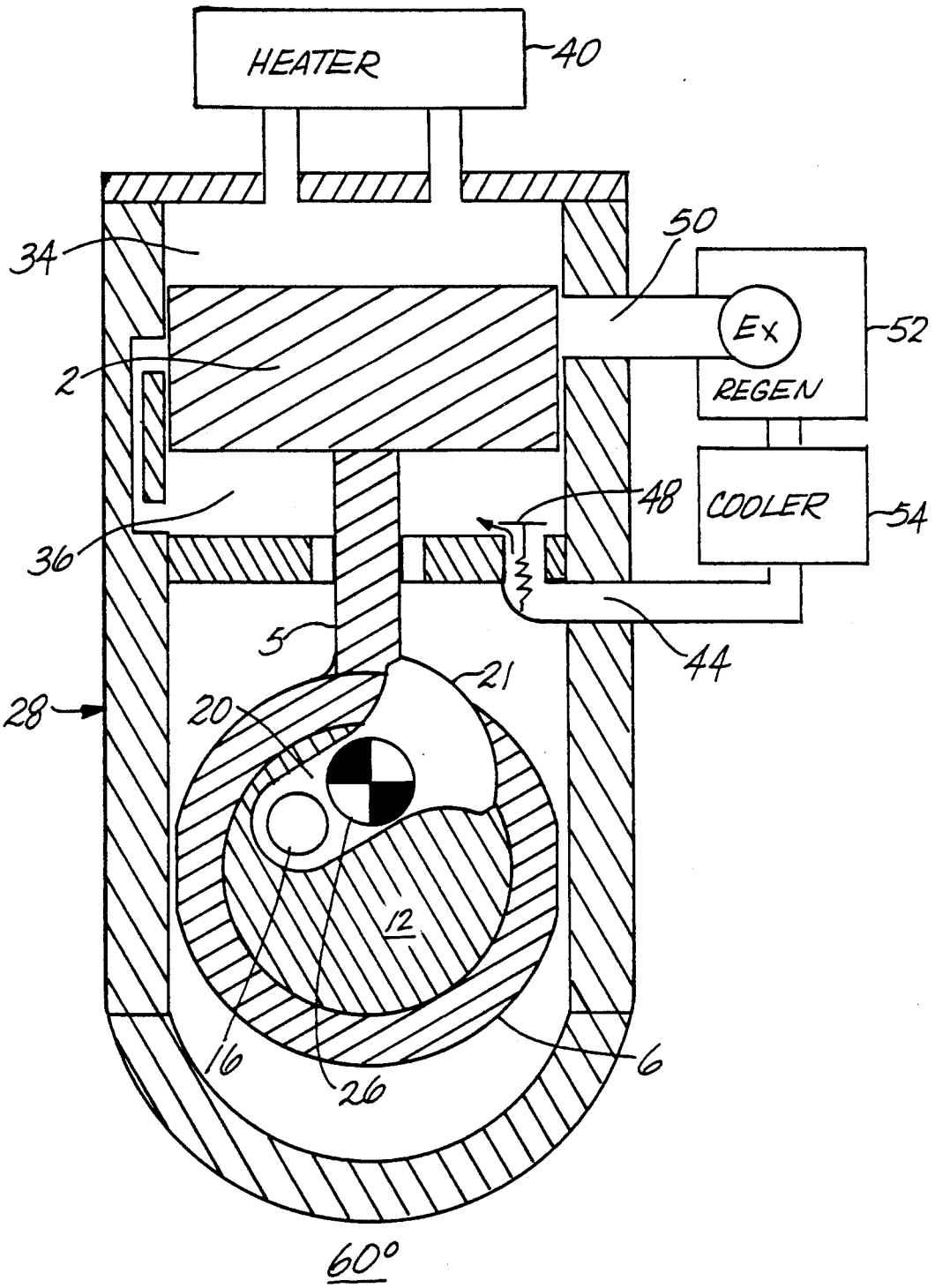
FIG. 2 is a similar view as FIG. 1, but with the piston on its upward, compression stroke and with the crankshaft rotated 60° clockwise from its position in FIG. 1.

In FIG. 2, as in all of the drawings, like reference numerals represent like elements. FIG. 2 shows the compression stroke continuing as piston 2 moves upwardly. The crankshaft 4 has rotated 60° from its position in FIG. 1. Piston 2 has traveled about one-half of its total range of movement, and cool working gases keep entering compression chamber 36 via port 44 and a valve 48.

Figure 3:
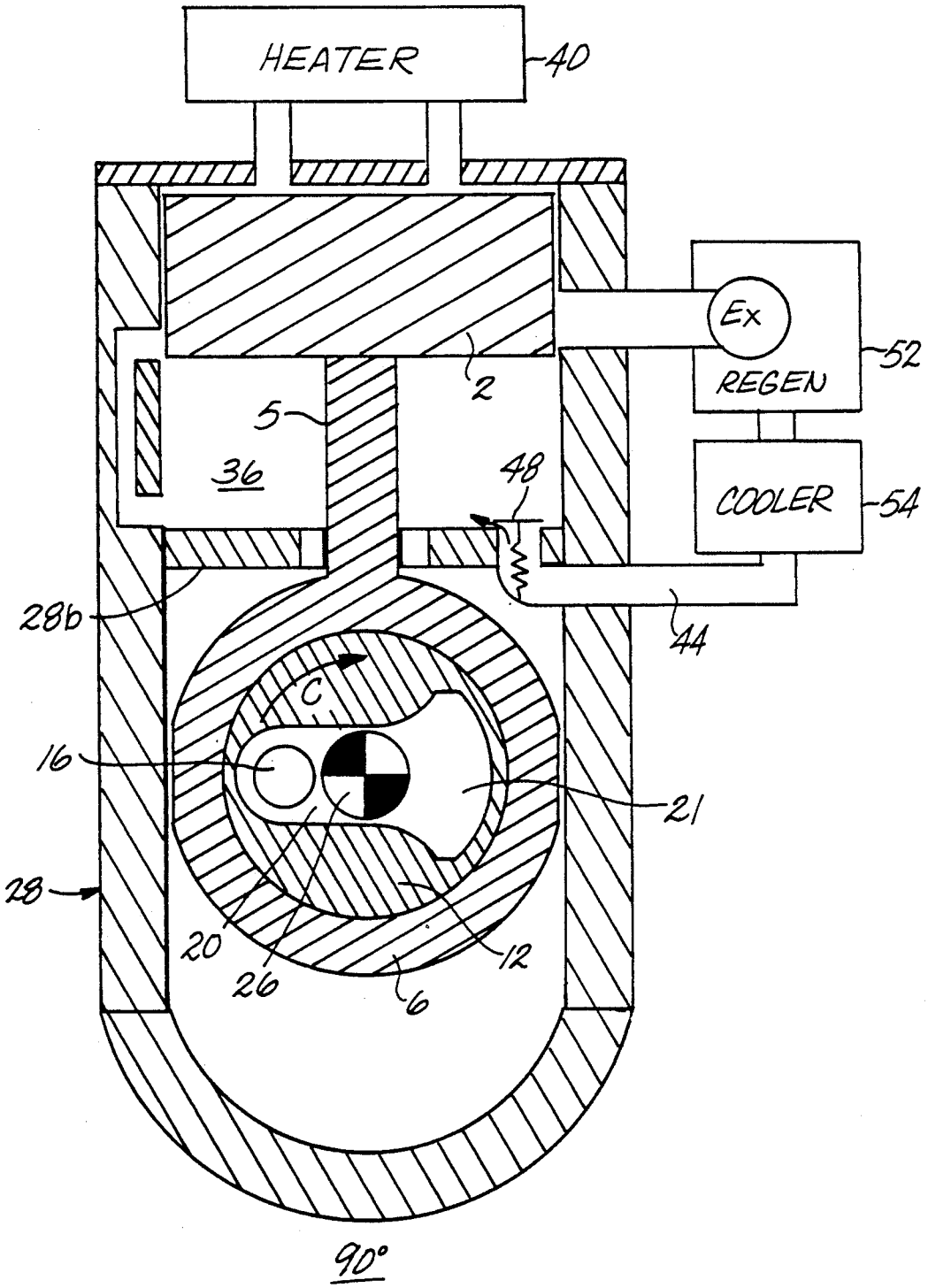
FIG. 3 is a view similar to FIG. 1, with the piston at the top of its compression stroke and the crankshaft rotated 90° from its position of FIG. 1.

In FIG. 3, the compression stroke is completed, as the piston has moved to its top position. Crankshaft 4 has rotated 90° from the position of FIG. 1. At this point, valve 48 will be closed, as is well known in the art, and gas in heater 40 is heating up. In accordance with the invention, when piston 2 and connecting ring 6 are in their top positions, disk 12 has its center axis O coaxial with the fixed axis P of main shaft 26 of crankshaft 4. Accordingly, as crankshaft 4 rotates from about 90° through about 270° (FIG. 4), disk 12 merely rotates in direction C and does not exert any substantial upward or downward force on connecting ring 6 other than to hold ring 6 in the top position. Therefore, substantially from the 90° position of FIG. 3 to the 270° position of the crankshaft 4 shown in FIG. 4, piston 2 remains at its top position. The working gas is thus heated very efficiently, as there is an increase in the time for heat transfer to take place. It should also be noted that, when the crankshaft reaches the 90° position, the disk will begin rotating in the clockwise direction as shown by arrow C in FIG. 3. The disk will continue its clockwise rotation until the 270° position.

Figure 4:
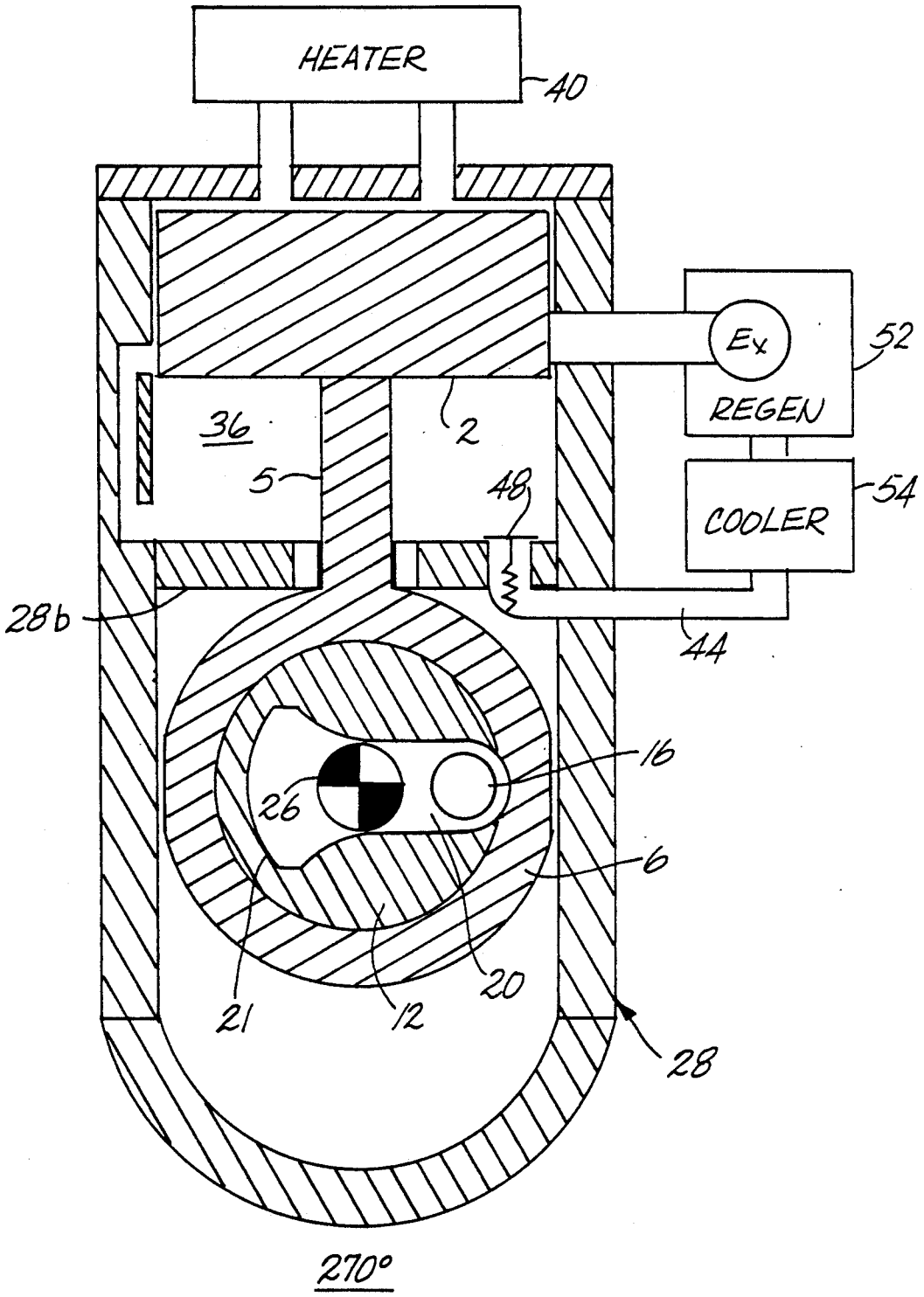
FIG. 4 is a view similar to FIG. 1, with the piston still at the top of its compression stroke and the crankshaft rotated 270° from its position of FIG. 1.
Figure 5:
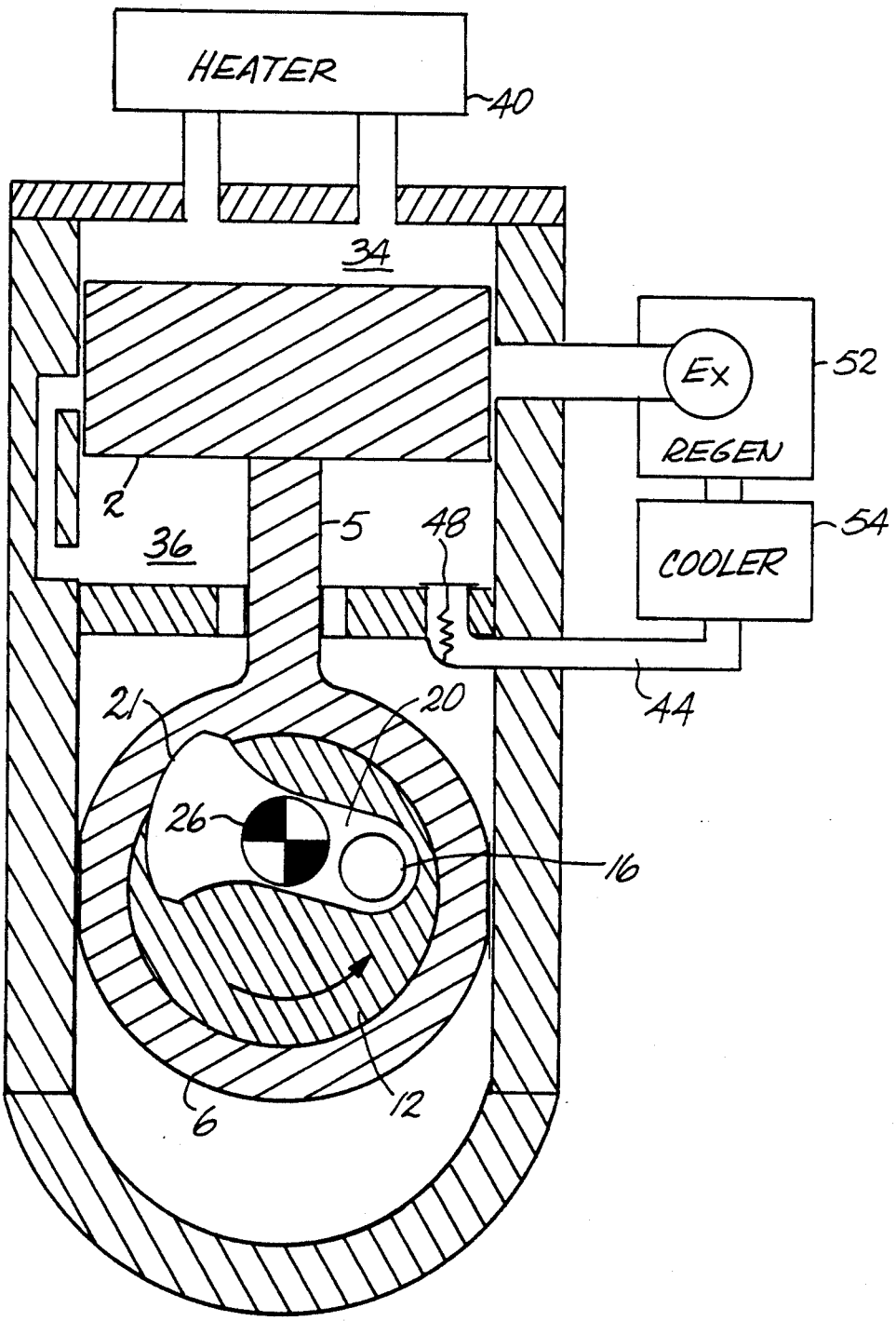
FIG. 5 is a view similar to FIG. 1, with the piston beginning its power stroke and the crankshaft rotated 285° from its position in FIG. 1.

FIG. 4 also represents the position where the power stroke is about to begin. In FIG. 5, a short while into the power stroke, crankshaft 4 is shown at 285°. Valve 48 remains closed, so compression of the cool working gases is taking place in chamber 36 while expansion is occurring in chamber 34.

Figure 6:
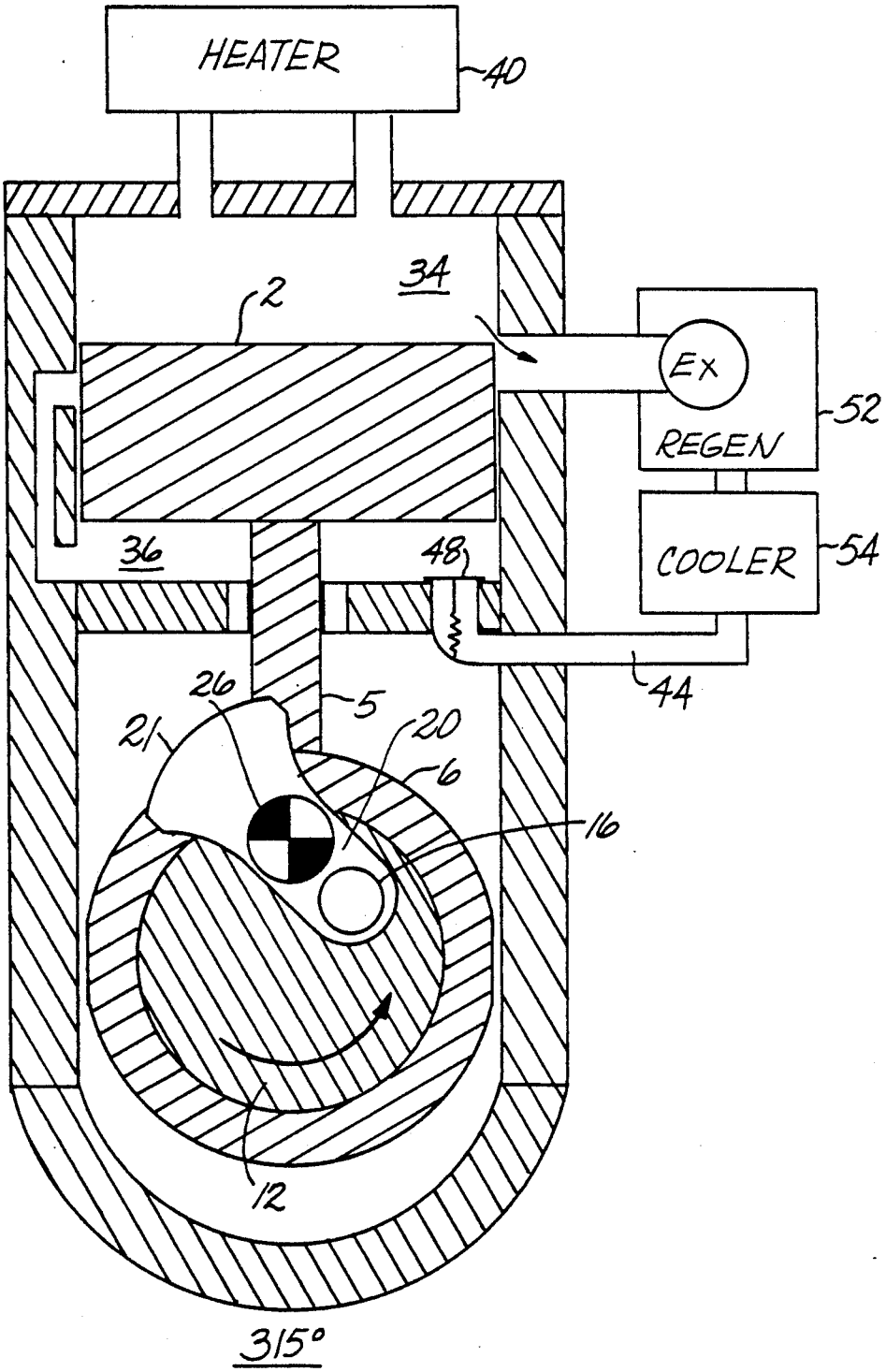
FIG. 6 is a view similar to FIG. 1, with the piston still in its power stroke, and the crankshaft rotated 315° from its position in FIG. 1.

FIG. 6 shows the crankshaft at 315°, at which point working gas from chamber 34 begins exhausting through an exhaust port 50. The gas enters regenerator 52 and then cooler 54.

Figure 7:
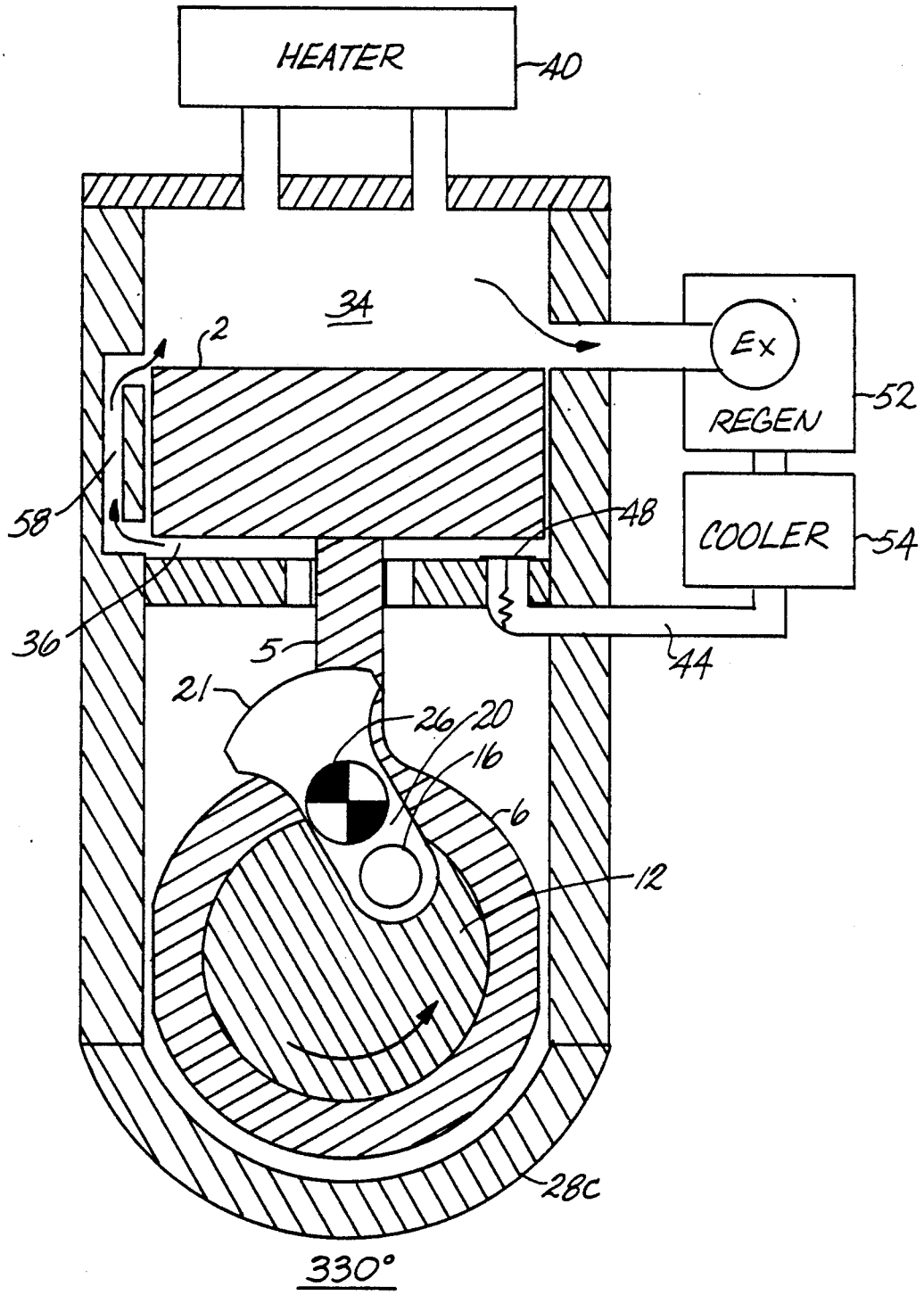
FIG. 7 is a view similar to FIG. 1, with the piston almost at the end of its power stroke, and with the crankshaft rotated 330° from its position in FIG. 1.

FIG. 7 shows crankshaft 4 at a rotation of 330°. At this point in the power stroke, hot gas still passes through exhaust port 50, regenerator 52 and cooler 54. In addition, cold gas moves from chamber 36 through passageway 58 into chamber 34. When piston 2 moves to its bottom position, crankshaft 4 and piston 2 are back at their positions as shown in FIG. 1. The cycle will then repeat.

From the drawings, it is apparent that the distance (range) of movement of the piston is set at twice the distance between the axes of the crank pin and the crankshaft.

As the invention is applied to an external combustion engine, and as it maintains the piston at the top of the compression stroke for substantially 180° of rotation of the crankshaft, combustion of the fuel can take place in a controlled manner and the working gas can be efficiently heated, to achieve an efficient engine and thus substantially reduce pollution and gas consumption.

Figure 8:
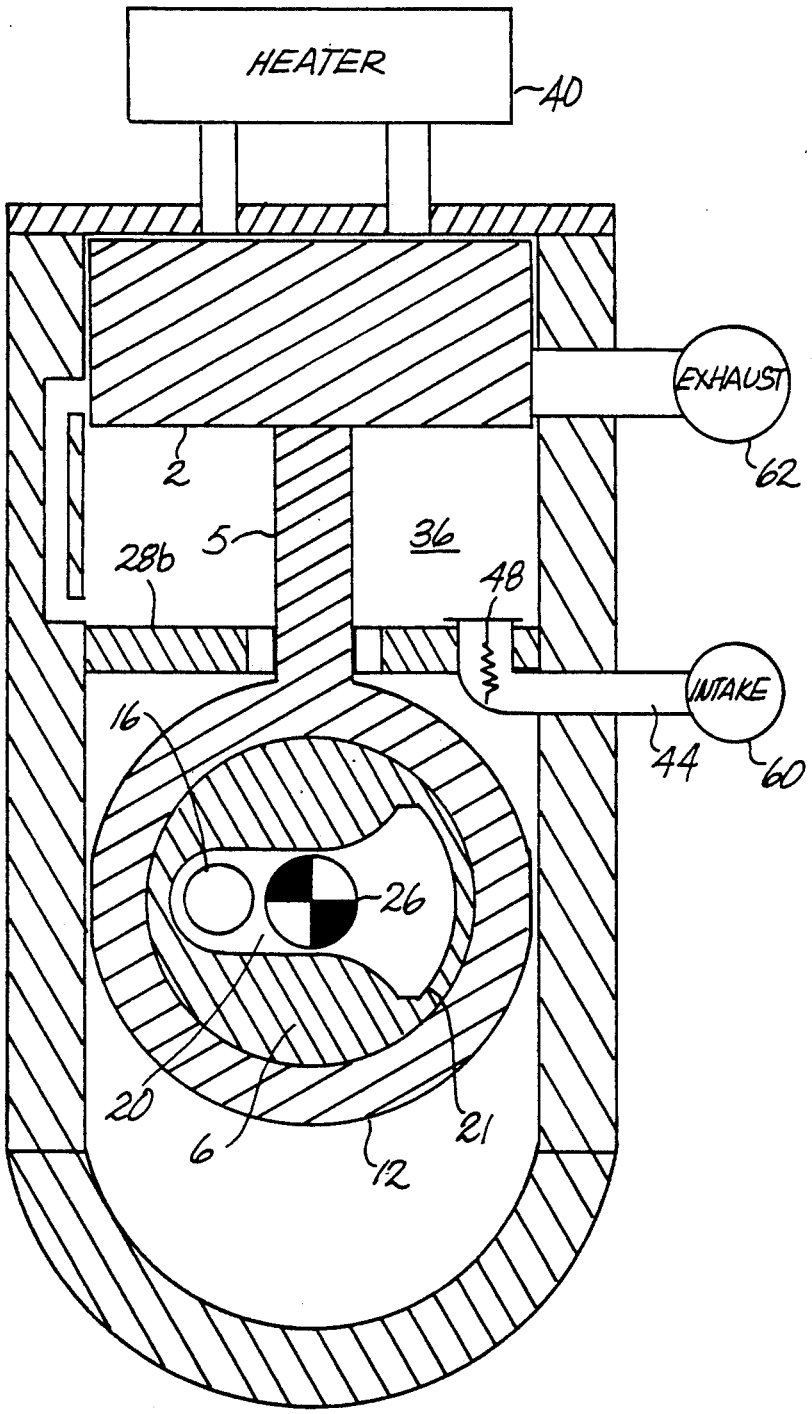
FIG. 8 is a view similar to FIG. 1, but of an alternative embodiment in which the engine is an open cycle-type.

The above described embodiment of the invention is for a closed cycle version of the external combustion engine. FIG. 8 shows an open-cycle version of the invention.

In the open-cycle version, the salient differences are that the working gas exhausted from chamber 34 by exhaust 62 does not reenter. Rather, fresh working gas enters chamber 36 through an intake device 60, which is well known in the art.

Figure 9:
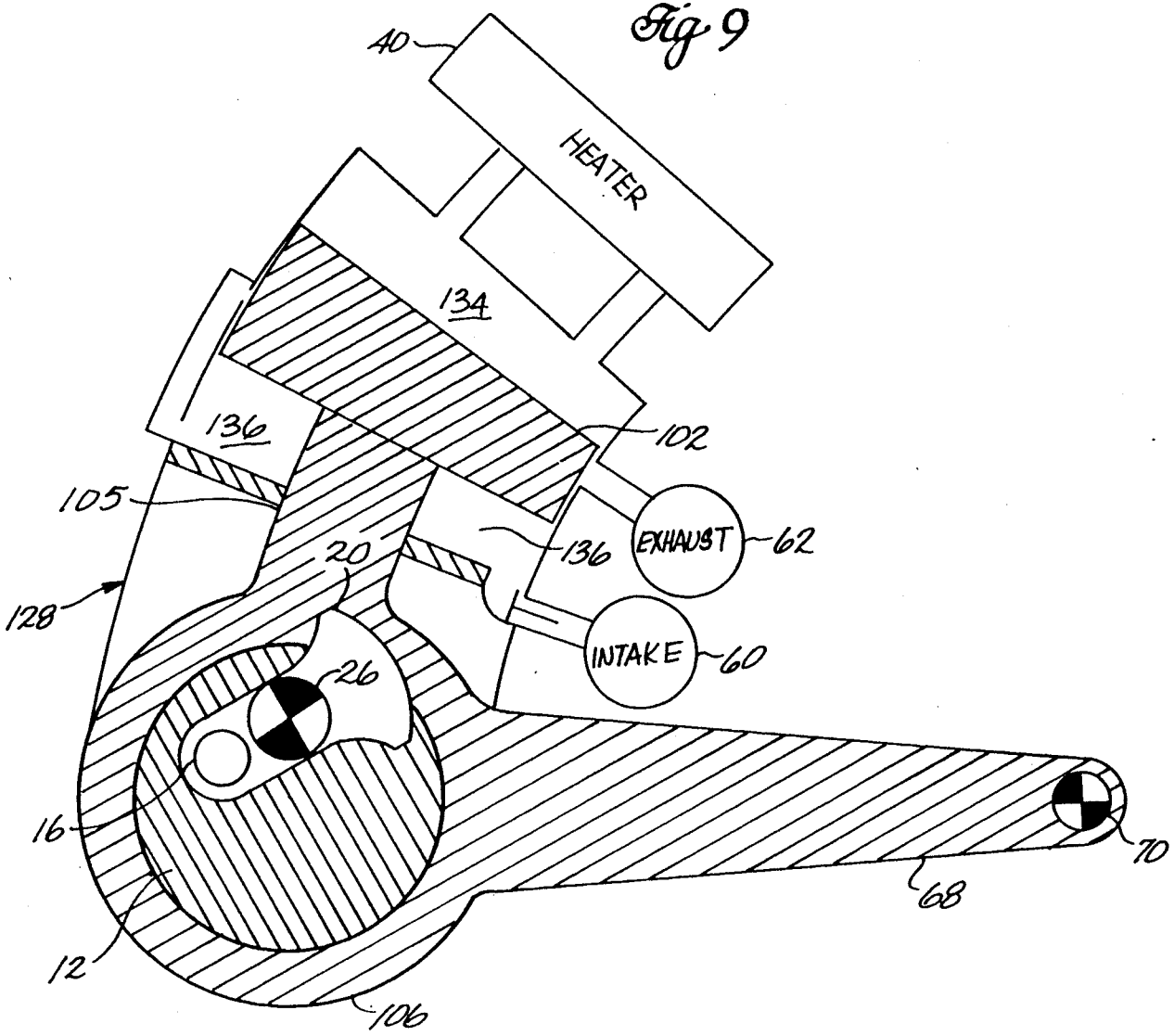
FIG. 9 is a view similar to FIG. 1, but of another alternative embodiment of the invention.

FIG. 9 is a further embodiment of the invention, in which piston 102 and piston rod 105 are curved. Compression and expansion chambers 134, 136, respectively, are curved. The curve of the piston 102, piston rod 105, and chambers 134 and 136 have a radius taken at its respective axis and point 70 approximately equal to that of a pivot arm 68, which is integral with connecting ring 106. Pivot arm 68 is mounted on a fixed rod 70 or other fixed pivot point. This structure gives more control to the movement of piston 102 and other moveable elements of the piston/crankshaft linkage. This embodiment otherwise functions the same as the previous embodiments.

Figure 10:
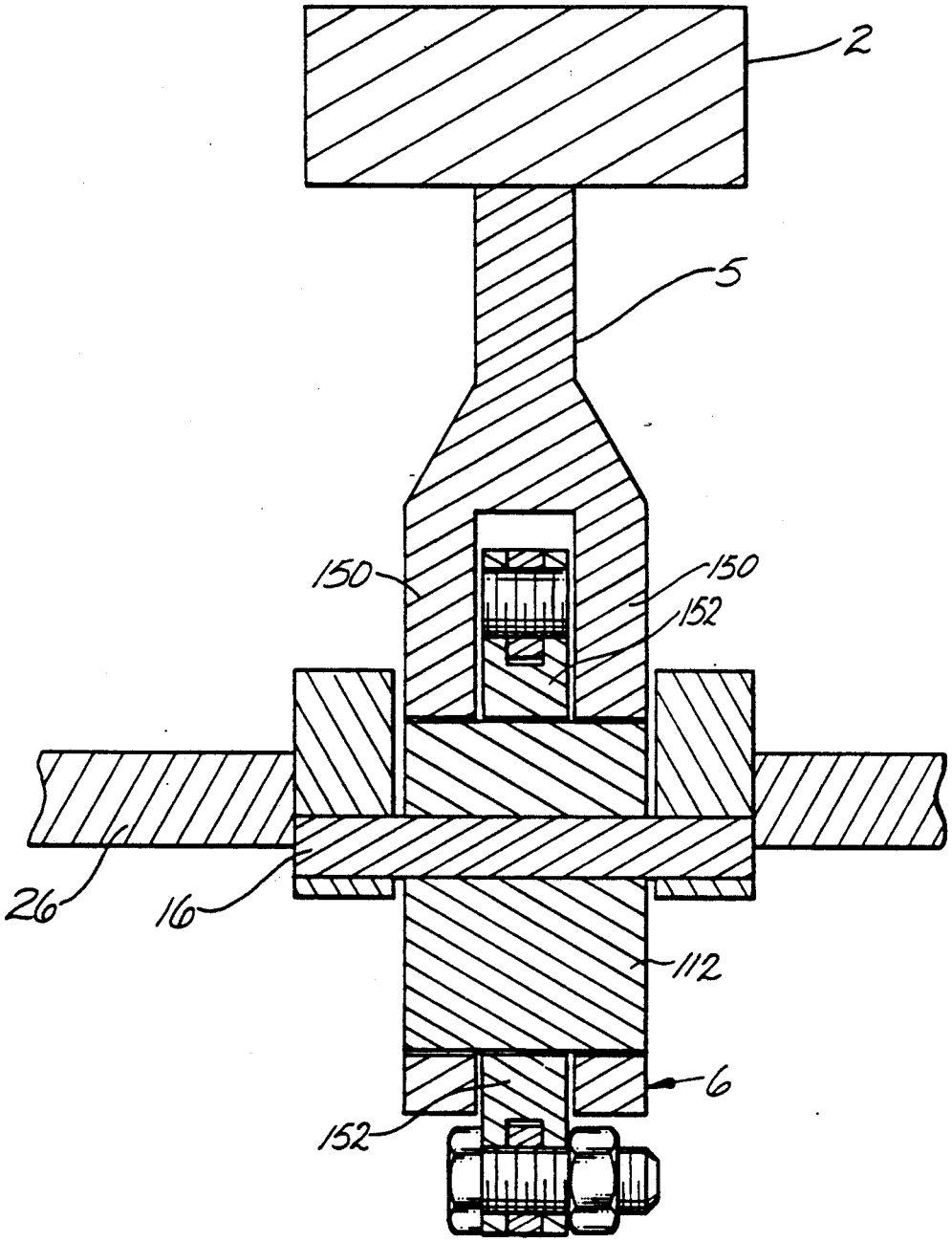
FIGS. 10 and 11 are a cross-sectional views of yet another embodiment of the invention.
Figure 11:
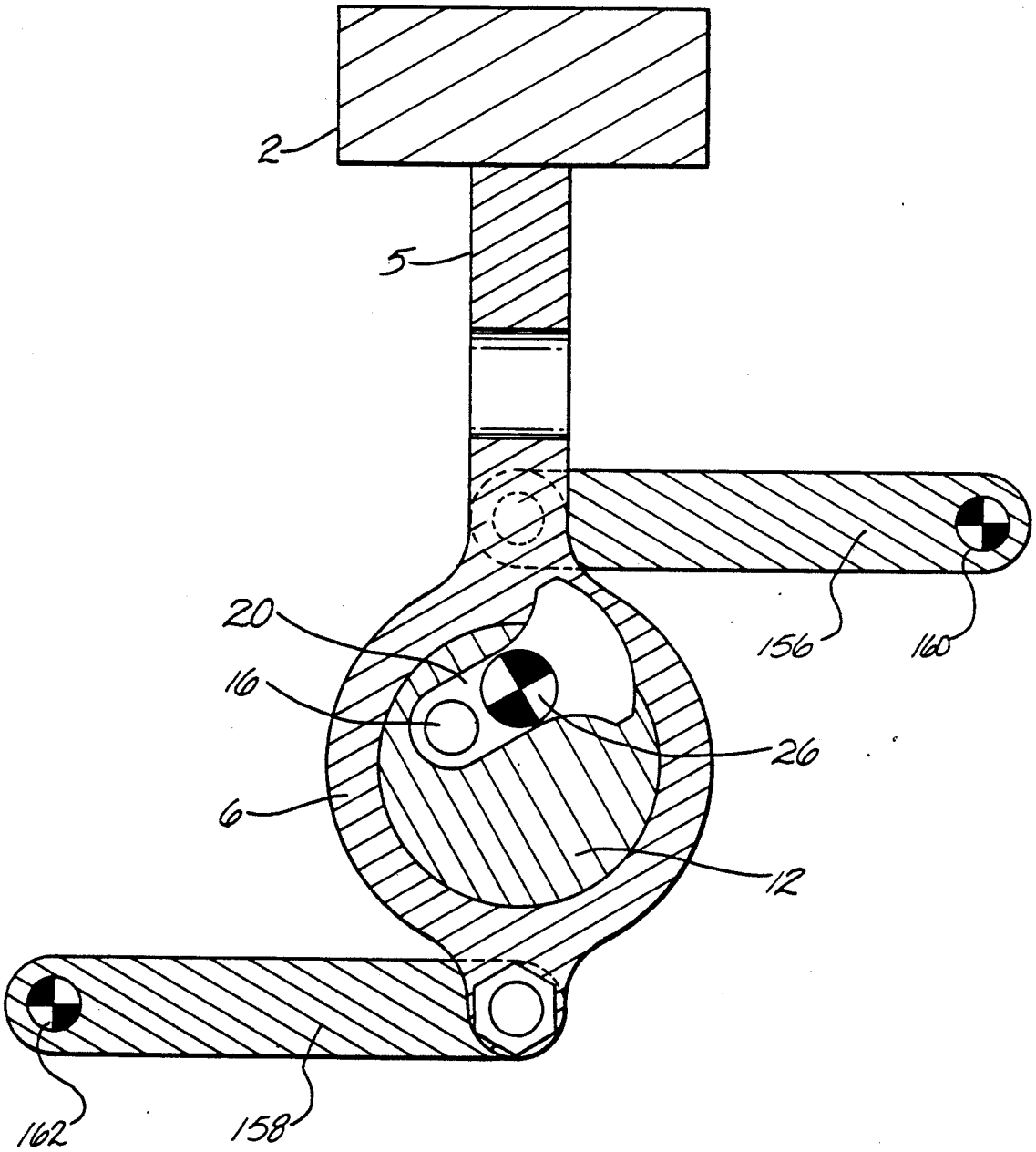

FIGS. 10 and 11 show another embodiment wherein the connecting ring 6 comprises two spaced-apart legs 150, each having a bore. Disk 12 is rotatably mounted in the bores of the connecting ring 6. A supporting ring 152 is mounted between the legs of the connecting ring 6, in surrounding relation to the disk 12. The disk 12 is a afforded rotatable movement Within supporting ring 152. Supporting ring 152 is pivotally connected to upper and lower pivot arms 156 and 158. The ends of the pivot arms 156 and 158 remote from the supporting ring 152 are pivotally attached to fixed rods 160 and 162 or other fixed pivot points. In this embodiment, the supporting ring 152 and pivot arms 156 and 158 prevent lateral movement of the disk connecting rod, thus assuring true vertical movement of the connecting rod and piston.

Figure 12:
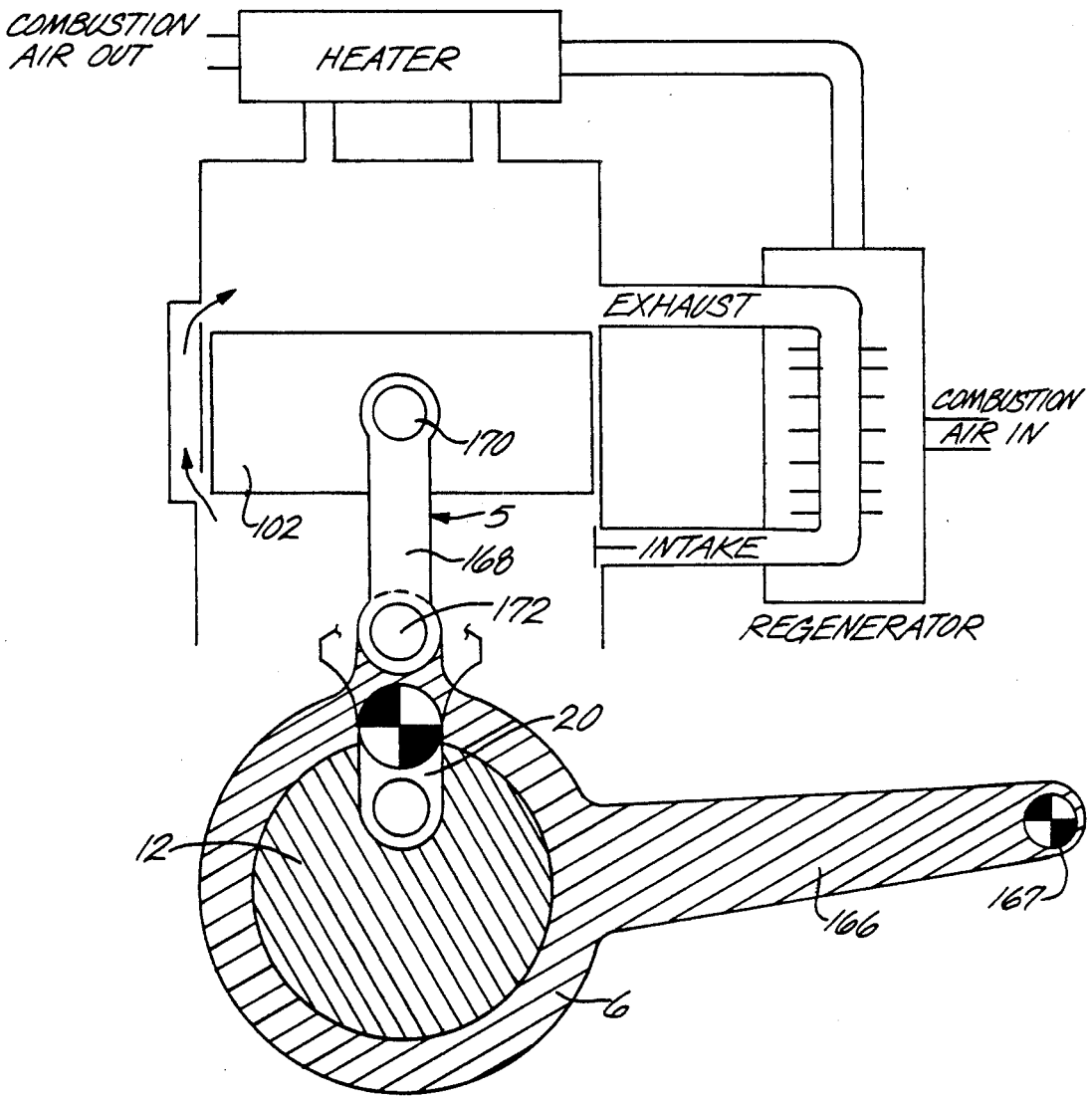
FIG. 12 is a cross-sectional view of yet a further embodiment of the invention.

FIG. 12 shows yet another embodiment of the invention wherein a pivot arm 166 is fixedly attached to the connecting ring 6. Pivot arm 166 is mounted on fixed rod 167 or other fixed pivot points. Connecting rod 5 comprises a shaft 168 which is pivotally connected at the upper end of piston 102 at point 170 and pivotally connected at its lower end to the connecting ring 6 at point 172. As in the embodiment shown in FIG. 9, this construction provides more contact to the movement of piston 102 and other moveable elements of piston/-crankshaft leakage.

The above-disclosed embodiments of the invention are exemplary, and are not intended to limit the scope of the appended claims which define the invention. For example, crankshaft 4 could be formed as one piece, which would include the crank arm 20 and pin 16, or it may be formed separately.

As another example, crank pin 16 may be rotatably mounted on crank arm 20. In such an embodiment, crank pin 16 may be fixedly attached or integral with disk 12.

What is claimed is:

1. A piston and connecting rod assembly comprising:

a piston;

a connecting rod attached at one end to the piston and extending downwardly from the piston, said connecting rod having an annular ring at its end opposite the piston and a disk, having a diameter slightly less than the diameter of the interior of the annular ring, mounted within the interior of the annular ring and afforded rotatable movement therein, said disk further comprising a hole offset from the axis of the disk for rotatably receiving a crank pin of a crankshaft.

2. A piston and connecting rod assembly comprising:

a piston;

a connecting rod attached at one end to the piston and extending downwardly from the piston, said connecting rod comprising:

an annular ring at its end opposite the piston;

a disk having a diameter slightly less than the diameter of the interior of the annular ring, mounted within the interior of the annular ring and afforded rotatable movement therein; and a crank pin fixedly attached to the disk at a position offset from the axis of the disk, said crank pin extending outwardly from at least one side of the disk in a direction generally parallel with the axis of the disk, wherein the crank pin is rotatably mountable on a crank arm of a crankshaft.

3. A crankshaft, piston and connecting rod assembly comprising:

a piston;

a connecting rod attached at one end to the piston and extending downwardly from the piston, said connecting rod having an annular ring at its end opposite the piston and a disk having a diameter slightly less than the diameter of the interior of the annular ring mounted within the interior of the annular ring and afforded rotatable movement therein, said disk further comprising a hole offset from the axis of the disk for rotatably receiving a crank pin of a crankshaft; and a crankshaft having a central shaft, a crank arm extending radially outwardly from the central shaft and a crank pin extending from the crank arm in a direction generally parallel with the axis of the central shaft through the hole in the disk; and wherein the distance between the axis of the central shaft and the crank pin is substantially the same as the distance between the axis of the disk and the center of the hole in the disk.

4. In an external heat engine having a piston mounted for movement between a first position and a second position, means for forcibly moving the piston from the first position to the second position (power stroke), a crankshaft rotatable about a main axis, and means for linking the piston and crankshaft so that linear movement of the piston from the first position to the second position during the power stroke is transformed into rotational movement of the crankshaft, the power stroke corresponding to a first portion of one rotation of the crankshaft about the main axis, the piston moving from the second position to the first position during a second portion of one rotation of the crankshaft (compression stroke), the improvement wherein the means for linking the piston and crankshaft comprises a rotatable member, means connected to the piston for rotatably supporting the rotatable member, the rotatable member being rotatable about a first point and being connected to the crankshaft at a second point offset from the first point, for rotation about the first point in response to rotation of the crankshaft about its main axis, the first point being disposed so that when the piston is in the first position, the first point is substantially aligned with the main axis of the crankshaft during a third portion of one rotation of the crankshaft about the main axis.

5. The engine of claim 4 wherein the third portion of one rotation of the crankshaft corresponds to substantially 180°.

6. The engine of claim 5 wherein the first and second portions of one rotation of the crankshaft each correspond to substantially 90°.

7. The engine of claim 4 wherein the first, second and third portions of one rotation of the crankshaft total 360°.

8. The engine of claim 4 wherein the rotatable member is a disk and the means for supporting comprises an annular connecting ring.

9. The engine of claim 8 wherein the piston is connected to the annular connecting ring by a piston rod.

10. The engine of claim 4 wherein the crankshaft has a crank pin corresponding to a step portion, and the crankshaft is connected to the rotatable member at the step portion.

11. The engine of claim 4 wherein the rotatable member is a disk having an aperture formed therein at the second point, and the crankshaft has a crank pin corresponding to a step portion which is connected to the disk through the aperture.

12. The engine of claim 10 further comprising a counter weight mounted to the main shaft of the crankshaft at the step portion.

13. The engine of claim 4 wherein the means for supporting has a pivot arm integrally connected thereto, the pivot arm being mounted for rotation about a third point.

14. In an external heat engine having a piston mounted for movement between a first position and a second position, means for forcibly moving the piston from the first position to the second position (power stroke), a crankshaft rotatable about a main axis, and a means for linking the piston and crankshaft so that linear movement of the piston from the first position to the second position during the power stroke is transformed into rotational movement of the crankshaft, the power stroke corresponding to a first portion of one rotation of the crankshaft about the main axis, the piston moving from the second position to the first position during a second portion of one rotation of the crankshaft (compression stroke), the improvement wherein the means for linking the piston and crankshaft comprises a rotatable member, means connected to the piston for rotatably supporting the rotatable member, the rotatable member being rotatable about a first point and being connected to the crankshaft at a second point offset from the first point, for rotation about the first point in response to rotation of the crankshaft about the main axis, when the piston is in the first position, the first point is substantially coaxial with the main axis of the crankshaft during a third portion of one rotation of the crankshaft about the main axis.

15. The engine of claim 14 wherein the first point is substantially aligned with the main axis of the crankshaft during a third portion of one rotation of the crankshaft about the main axis.

16. The engine of claim 14 wherein the first and second portions of one rotation of the crankshaft each correspond to substantially 90° of one rotation of the crankshaft.

17. The engine of claim 14 wherein the first, second and third portions of one rotation of the crankshaft total 360°.

18. The engine of claim 1 wherein the rotatable member is a disk and the means for supporting comprises an annular connecting ring.

* * * * *